US011763777B2

(12) United States Patent
Yasuda

(10) Patent No.: US 11,763,777 B2
(45) Date of Patent: Sep. 19, 2023

(54) IMAGE DISPLAY DEVICE, IMAGE DISPLAY SYSTEM, IMAGE DISPLAY METHOD, AND COMPUTER PROGRAM FOR PROVIDING A LOW-LUMINANCE GRAYSCALE STANDARD DISPLAY FUNCTION (GSDF) DISPLAY

(71) Applicant: EIZO Corporation, Hakusan (JP)

(72) Inventor: Tetsuya Yasuda, Hakusan (JP)

(73) Assignee: EIZO Corporation, Hakusan (JP)

( * ) Notice: Subject to any disclaimer, the term of this patent is extended or adjusted under 35 U.S.C. 154(b) by 70 days.

(21) Appl. No.: 17/612,356

(22) PCT Filed: May 23, 2019

(86) PCT No.: PCT/JP2019/020553
§ 371 (c)(1),
(2) Date: Nov. 18, 2021

(87) PCT Pub. No.: WO2020/235109
PCT Pub. Date: Nov. 26, 2020

(65) Prior Publication Data

US 2022/0215814 A1 Jul. 7, 2022

(51) Int. Cl.
*G09G 5/10* (2006.01)

(52) U.S. Cl.
CPC ..... *G09G 5/10* (2013.01); *G09G 2360/16* (2013.01); *G09G 2380/08* (2013.01)

(58) Field of Classification Search
CPC .. G09G 5/10; G09G 2360/16; G09G 2380/08; G09G 2320/0271;
(Continued)

(56) References Cited

U.S. PATENT DOCUMENTS 7,852,349 B2 * 12/2010 Yamano ..... G09G 5/02 345/589
7,920,145 B2 * 4/2011 Yamano ..... H04N 1/644 345/589
(Continued)

FOREIGN PATENT DOCUMENTS

CN 102629379 A 8/2012
CN 104363445 A 2/2015
(Continued)

OTHER PUBLICATIONS

Xu et al., "Display methods for adjustable grayscale and luminance depth"; Medical Imaging 2008: PACS and Imaging Informatics; 2008; vol. 6919, pp. 1-7.
(Continued)

*Primary Examiner* — Rodney Amadiz
(74) *Attorney, Agent, or Firm* — Maier & Maier, PLLC

(57) ABSTRACT

An image display device, image display system, image display method and computer program which are configured so that not only the gradation characteristic at the luminance over 0.05 (cd/m2) but also the gradation characteristic at the luminance less than 0.05 (cd/m2) satisfies the DICOM. The image display device includes an image display unit; and an image processing unit. The image processing unit is configured to display the image data on the image display unit based on first and second gradation characteristics, a luminance of the first gradation characteristic is 0.05 (cd/m2) or more, a luminance of the second gradation characteristic is less than 0.05 (cd/m2), the first gradation characteristic complies with GSDF (Grayscale Standard Display Function) gradation characteristic of DICOM standard, and the first and second gradation characteristics are defined to satisfy a relationship between a JND value and a corresponding luminance.

14 Claims, 13 Drawing Sheets

(58) Field of Classification Search
CPC ... G09G 2320/0626; G09G 2320/0693; G09G 3/20; G09G 3/36; G09G 3/3208; G09G 2310/027; G09G 2320/0233
See application file for complete search history.

(56) References Cited

U.S. PATENT DOCUMENTS

| | | | | |
|---|---|---|---|---|
| 2007/0067124 | A1* | 3/2007 | Kimpe | G09G 3/2092 702/67 |
| 2007/0152949 | A1* | 7/2007 | Sakai | G09G 3/3607 345/102 |
| 2007/0285516 | A1* | 12/2007 | Brill | H04N 21/43615 348/739 |
| 2008/0303806 | A1* | 12/2008 | Perrin | G09G 3/3611 345/207 |
| 2011/0175552 | A1 | 7/2011 | Kwon et al. | |
| 2012/0154355 | A1* | 6/2012 | Kawai | H04N 5/58 345/207 |
| 2013/0187958 | A1* | 7/2013 | Kimpe | G09G 3/3208 345/690 |
| 2013/0287313 | A1* | 10/2013 | Marchessoux | G06T 5/007 382/274 |
| 2014/0363093 | A1 | 12/2014 | Miller et al. | |
| 2017/0221405 | A1 | 8/2017 | Yoshida et al. | |
| 2017/0263211 | A1 | 9/2017 | Miller et al. | |
| 2021/0241718 | A1* | 8/2021 | Tsubokura | G09G 5/10 |

FOREIGN PATENT DOCUMENTS

| | | | |
|---|---|---|---|
| CN | 107316623 | A | 11/2017 |
| JP | 2006184305 | A | 7/2006 |
| JP | 3974630 | B2 | 9/2007 |
| JP | 2015-510600 | A | 4/2015 |
| WO | 2016/013125 | A1 | 1/2016 |

OTHER PUBLICATIONS

National Electrical Manufacturers Association, "Digital Imaging and Communications in Medicine (DICOM) Part 14: Greyscale Standard Display Function"; XP-002557603; 2006; pp. 1-55.
Extended European Search Report dated Apr. 11, 2022 in corresponding European Patent Application No. 19929996.7; 13 pages.
International Search Report dated Aug. 20, 2019 in corresponding International application No. PCT/JP2019/020553; 3 pages.
Examination Report dated Nov. 2, 2021 of corresponding Japanese application No. 2021-520031; 6 pages.
Office Action dated Mar. 31, 2023, in corresponding Chinese Application No. 201980096630.4, 16 pages.
Tian et al., "Calibration and Quality Control of Medical Image Monitor", Chinese Medical Equipment Journal, 2017, vol. 38, No. 12, pp. 89-90 and 94, partial English translation provided.

* cited by examiner

FIG. 6A

(FORMULA 1) CONTRAST SENSITIVITY FUNCTION $$S(L) = \frac{q_1 \cdot M_{opt}(L)}{\sqrt{\frac{q_2}{d^2 L} + q_3}}$$

| |
|---|
| $q_1 = 0.1183034375$ |
| $q_2 = 3.962774805 \cdot 10^{-5}$ |
| $q_3 = 1.356243499 \cdot 10^{-7}$ |

$$M_{opt}(u) = e^{-\pi^2 \sigma^2 u^2} \qquad \sigma = \sqrt{\sigma_0^2 + (C_{sph} \cdot d^3)^2}$$

FIG. 6B

(FORMULA 2) FORMULA FOR CALCULATING LUMINANCE CORRESPONDING TO NEXT 1JND DIFFERENCE FROM THE CONTRAST SENSITIVITY FUNCTION $$L_{n+1} = -1 * L_n \cdot \frac{1 + S(L_n)}{1 - S(L_n)}$$

FIG. 7A

(FORMULA 3) FORMULA FOR CONVERTING LUMINANCE TO JND VALUE $$j(L) = A + B \cdot Log_{10}(L) + C \cdot (Log_{10}(L))^2 + D \cdot (Log_{10}(L))^3 + E \cdot (Log_{10}(L))^4 + F \cdot (Log_{10}(L))^5 + G \cdot (Log_{10}(L))^6 + H \cdot (Log_{10}(L))^7 + I \cdot (Log_{10}(L))^8$$

| | | |
|---|---|---|
| A = 71.498068 | B = 94.593053 | C = 41.912053 |
| D = 9.8247004 | E = 0.28175407 | F = -1.1878455 |
| G = -0.18014349 | H = 0.14710899 | I = - 0.017046845 |

FIG. 7B

(FORMULA 4) FORMULA FOR CONVERTING JND VALUE TO LUMINANCE $$\log_{10} L(j) = \frac{a + c \cdot Ln(j) + e \cdot (Ln(j))^2 + g \cdot (Ln(j))^3 + m \cdot (Ln(j))^4}{1 + b \cdot Ln(j) + d \cdot (Ln(j))^2 + f \cdot (Ln(j))^3 + h \cdot (Ln(j))^4 + k \cdot (Ln(j))^5}$$

| | | |
|---|---|---|
| a = -1.3011877 | b = -2.5840191E-2 | c = 8.0242636E-2 |
| d = -1.0320229E-1 | e = 1.3646699E-1 | f = 2.8745620E-2 |
| g = -2.5468404E-2 | h = -3.1978977E-3 | k = 1.2992634E-4 |
| m = 1.3635334E-3 | | |

FIG. 8A

(FORMULA 5) FORMULA FOR CALCULATING ΔJND $$\Delta JND = (J_{max} - J_{min_tmp} + J_{ext}) / 255$$
$$= (810.49 - 1.62 + 19)$$
$$= 3.246$$

VALUE CORRESPONDING TO NUMBER OF GRADATIONS

| |
|---|
| ΔJND : EXTENDED JND DIFFERENCE |
| $J_{max}$ : MAXIMUM JND VALUE |
| $J_{min_tmp}$ : TEMPORARY MINIMUM JND VALUE |
| $J_{ext}$ : EXTENDED JND DIFFERENCE |

FIG. 8B

(FORMULA 6) FORMULA FOR CALCULATING TARGET JND VALUE (Jm_target) FOR EACH GRADATION $$J_{m_target} = J_{max} - \Delta JND \times (255 - m)$$

| |
|---|
| $\Delta J_{m_target}$ : TARGET JND VALUE FOR EACH GRADATION |
| $J_{max}$ : MAXIMUM JND VALUE |

FIG. 8C

(FORMULA 7) FORMULA FOR CALCULATING TARGET JND VALUE (Jm_target) FOR EACH GRADATION $$J_{m_target} = (J_{max} - J_{min}) \times (255/m) + J_{min}$$

| |
|---|
| $J_{max}$ : MAXIMUM JND VALUE |
| $J_{min}$ : MINIMUM JND VALUE |

FIG. 11

TARGET JND VALUE CORRESPONDING TO EXTENDED JND INDEX

| GRADATION | TARGET JND VALUE | TARGET LUMINANCE VALUE |
|---|---|---|
| 0 | -17.4 | 0.00153 |
| 1 | -14.1 | 0.00536 |
| 2 | -10.9 | 0.01120 |
| 3 | -7.6 | 0.01904 |
| 4 | -4.4 | 0.02893 |
| 5 | -1.1 | 0.04091 |
| 6 | 2.1 | 0.05514 |
| 7 | 5.3 | 0.07142 |
| 8 | 8.6 | 0.09021 |
| 9 | 11.8 | 0.11133 |
| 10 | 15.1 | 0.13483 |
| ⋮ | | |
| 246 | 781.3 | 825.02255 |
| 247 | 784.5 | 842.88102 |
| 248 | 787.8 | 861.11661 |
| 249 | 791.0 | 879.73729 |
| 250 | 794.3 | 898.75119 |
| 251 | 797.5 | 918.16662 |
| 252 | 800.7 | 937.99208 |
| 253 | 804.0 | 958.23622 |
| 254 | 807.2 | 978.90791 |
| 255 | 810.5 | 1000.01618 |

IMAGE DISPLAY DEVICE, IMAGE DISPLAY SYSTEM, IMAGE DISPLAY METHOD, AND COMPUTER PROGRAM FOR PROVIDING A LOW-LUMINANCE GRAYSCALE STANDARD DISPLAY FUNCTION (GSDF) DISPLAY

TECHNICAL FIELD

The present invention relates to an image display device, an image display system, an image display method, and a computer program.

BACKGROUND

Improvements in image processing technology have made it possible to produce the image display devices that can display images with high contrast ratio. Such the image display device is capable of setting the gradation corresponding to the luminance of less than 0.05 (cd/m$^2$). Here, the gradation characteristic of the image display device for medical use is required to comply with the GSDF (Grayscale Standard Display Function) of the DICOM standard (hereinafter referred to as the DICOM). Therefore, an image display device that can display images of the gradation characteristic in compliance with the GSDF has been proposed (see, for example, patent literature 1). The GSDF of the DICOM is based on a theory called the Barten-Model.

The image display device described in patent literature 1 calculates the JND value corresponding to the maximum luminance and the JND value corresponding to the minimum luminance, and then calculates the target luminance for each gradation based on these JND values. In patent literature 1, the calculated target luminance shows the gradation characteristic in compliance with the GSDF. Here, the corresponding luminance corresponding to each JND index specified by the DICOM is 0.05 (cd/m$^2$) or more. Therefore, if the minimum luminance preset for the image display device is 0.05 (cd/m$^2$) or more, the image display device described in patent literature 1 can display images that comply with the GSDF.

PATENT LITERATURE

[Patent Literature 1] The publication of Japanese Patent No. 3974630

SUMMARY OF INVENTION

The JND Index (JND value) corresponding to the luminance less than 0.05 (cd/m$^2$) is not clearly indicated in the DICOM. Therefore, when the technology described in patent literature 1 is applied to the image display device that is capable of displaying images with high contrast ratio, if the minimum luminance preset for the image display device is less than 0.05 (cd/m$^2$), it is considered that the luminance of the low-gradation display image is outside the GSDF.

An object of the present invention is to provide the image display device, the image display system, the image display method and the computer program in which the gradation characteristics compatible with the GSDF are extended to a luminance range of less than 0.05 (cd/m$^2$).

The present invention provides an image display device for medical use configured to display image data comprising: an image display unit; and an image processing unit, wherein the image processing unit is configured to display the image data on the image display unit based on first and second gradation characteristics, a luminance of the first gradation characteristic is 0.05 (cd/m$^2$) or more, a luminance of the second gradation characteristic is less than 0.05 (cd/m$^2$), the first gradation characteristic complies with GSDF (Grayscale Standard Display Function) gradation characteristic of DICOM standard, and the first and second gradation characteristics are defined to satisfy a relationship between a JND value and a corresponding luminance.

The configuration of the present invention is configured to display image data on the image display unit based on the first and second gradation characteristics. Here, the first gradation characteristic (the gradation characteristic having the luminance of 0.05 (cd/m$^2$) or more) complies with the gradation characteristic of the GSDF of the DICOM standard and satisfies the relationship between the JND value (JND index) and the corresponding luminance corresponding to the JND value. The second gradation characteristic (the gradation characteristic having the luminance less than 0.05 (cd/m$^2$)) also satisfies the relationship between the JND value (JND index) and the corresponding luminance corresponding to the JND value. Therefore, the gradation characteristic of the invention, which is compatible with the GSDF, is extended to the luminance region of less than 0.05 (cd/m$^2$).

Various embodiments of the present invention are described below. Any of the embodiments described below can be combined with one another.

Preferably, the relationship of the second gradation characteristic corresponds to a relationship between a target JND value and a corresponding target luminance, the target luminance corresponds to the corresponding luminance, the target JND value is calculated based on a maximum JND value, an extended JND difference, a temporary minimum JND value, and the number of gradation, the maximum JND value corresponds to a maximum luminance of the image display unit, the temporary minimum JND value corresponds to a temporary minimum luminance, and the temporary minimum JND value is calculated from a minimum luminance using a predetermined relationship, the minimum luminance is less than 0.05 (cd/m$^2$), when the minimum luminance is given, the predetermined relationship is capable of recursively calculating a luminance corresponding to a JND value that is n ($n \geq 1$) larger than a minimum JND value corresponding to the minimum luminance, the temporary minimum luminance is a luminance that becomes larger than a predetermined luminance for the first time when a recursive calculation of each luminance using the predetermined relationship is repeated, and the extended JND difference corresponds to the number of luminance, which is used to calculate the temporary minimum luminance, smaller than the temporary minimum luminance.

Preferably, the image display device further comprises: an arithmetic processing unit, wherein the arithmetic processing unit includes an extended JND difference calculation part, a target JND value calculation part, and a target luminance calculation part, the extended JND difference calculation part calculates a temporary minimum luminance from a minimum luminance using a predetermined relationship and calculates an extended JND difference, when the minimum luminance is given, the predetermined relationship is capable of recursively calculating a luminance corresponding to a JND value that is n ($n \geq 1$) larger than a minimum JND value corresponding to the minimum luminance, the temporary minimum luminance is a luminance that becomes larger than a predetermined luminance for the first time when a recursive calculation of each luminance using the predetermined relationship is repeated, the minimum luminance is less than 0.05 (cd/m$^2$), the extended JND difference corresponds to the number of luminance, which is used to calculate the temporary minimum luminance, smaller than the temporary minimum luminance, the target JND value calculation part calculates a target JND value for each gradation based on a maximum JND value corresponding to a maximum luminance of the image display unit, the extended JND difference, a temporary minimum JND value corresponding to the temporary minimum luminance, and the number of gradation, the target luminance calculation part calculates a target luminance based on the target JND value, the target JND value corresponds to the JND value of the first and second gradation characteristics, and the target luminance corresponds to the corresponding luminance of the first and second gradation characteristics.

Preferably, the JND value is used in an arithmetic processing unit, the JND value for the first gradation characteristic is assigned a real number larger than or equal to 1, and the JND value for the second gradation characteristic is assigned a real number less than 1.

Preferably, a JND index is used in an arithmetic processing unit, the JND index for the first gradation characteristic is assigned an integer larger than or equal to 1, and the JND index for the second gradation characteristic is assigned an integer less than 1.

Preferably, the JND index for the second gradation characteristic is assigned a negative integer.

Another aspect of the present invention provides an image display system for medical use configured to display image data comprising: an image display unit; and an image processing unit, wherein the image processing unit is configured to display the image data on the image display unit based on first and second gradation characteristics, a luminance of the first gradation characteristic is 0.05 (cd/m$^2$) or more, a luminance of the second gradation characteristic is less than 0.05 (cd/m$^2$), the first gradation characteristic complies with GSDF (Grayscale Standard Display Function) gradation characteristic of DICOM standard, and the first and second gradation characteristics are defined to satisfy a relationship between a JND value and a corresponding luminance.

Preferably, the relationship of the second gradation characteristic corresponds to a relationship between a target JND value and a corresponding target luminance, the target luminance corresponds to the corresponding luminance, the target JND value is calculated based on a maximum JND value, an extended JND difference, a temporary minimum JND value, and the number of gradation, the maximum JND value corresponds to a maximum luminance of the image display unit, the temporary minimum JND value corresponds to a temporary minimum luminance, and the temporary minimum JND value is calculated from a minimum luminance using a predetermined relationship, the minimum luminance is less than 0.05 (cd/m$^2$), when the minimum luminance is given, the predetermined relationship is capable of recursively calculating a luminance corresponding to a JND value that is n ($n \geq 1$) larger than a minimum JND value corresponding to the minimum luminance, the temporary minimum luminance is a luminance that becomes larger than a predetermined luminance for the first time when a recursive calculation of each luminance using the predetermined relationship is repeated, and the extended JND difference corresponds to the number of luminance, which is used to calculate the temporary minimum luminance, smaller than the temporary minimum luminance.

Preferably, the image display system further comprises: an arithmetic processing unit, wherein the arithmetic processing unit includes an extended JND difference calculation part, a target JND value calculation part, and a target luminance calculation part, the extended JND difference calculation part calculates a temporary minimum luminance from a minimum luminance using a predetermined relationship and calculates an extended JND difference, when the minimum luminance is given, the predetermined relationship is capable of recursively calculating a luminance corresponding to a JND value that is n ($n \geq 1$) larger than a minimum JND value corresponding to the minimum luminance, the temporary minimum luminance is a luminance that becomes larger than a predetermined luminance for the first time when a recursive calculation of each luminance using the predetermined relationship is repeated, the minimum luminance is less than 0.05 (cd/m$^2$), the extended JND difference corresponds to the number of luminance, which is used to calculate the temporary minimum luminance, smaller than the temporary minimum luminance, the target JND value calculation part calculates a target JND value for each gradation based on a maximum JND value corresponding to a maximum luminance of the image display unit, the extended JND difference, a temporary minimum JND value corresponding to the temporary minimum luminance, and the number of gradation, the target luminance calculation part calculates a target luminance based on the target JND value, the target JND value corresponds to the JND value of the first and second gradation characteristics, and the target luminance corresponds to the corresponding luminance of the first and second gradation characteristics.

Preferably, the JND value is used in an arithmetic processing unit, the JND value for the first gradation characteristic is assigned a real number larger than or equal to 1, and the JND value for the second gradation characteristic is assigned a real number less than 1.

Preferably, a JND index is used in an arithmetic processing unit, the JND index for the first gradation characteristic is assigned an integer larger than or equal to 1, and the JND index for the second gradation characteristic is assigned an integer less than 1.

Preferably, the JND index for the second gradation characteristic is assigned a negative integer.

Another aspect of the present invention provides an image display method for medical use and displaying image data comprising: a display step of displaying the image data on an image display unit based on first and second gradation characteristics, wherein a luminance of the first gradation characteristic is 0.05 (cd/m$^2$) or more, a luminance of the second gradation characteristic is less than 0.05 (cd/m$^2$), the first gradation characteristic complies with GSDF (Grayscale Standard Display Function) gradation characteristic of DICOM standard, and the first and second gradation characteristics are defined to satisfy a relationship between a JND value and a corresponding luminance.

Another aspect of the present invention provides a computer program causing a computer to execute an image display method for medical use and displaying image data comprising: a display step of displaying the image data on an image display unit based on first and second gradation characteristics, wherein a luminance of the first gradation characteristic is 0.05 (cd/m$^2$) or more, a luminance of the second gradation characteristic is less than 0.05 (cd/m$^2$), the first gradation characteristic complies with GSDF (Grayscale Standard Display Function) gradation characteristic of DICOM standard, and the first and second gradation characteristics are defined to satisfy a relationship between a JND value and a corresponding luminance.

BRIEF DESCRIPTION OF DRAWINGS

FIG. 6A shows a contrast sensitivity function derived from a Barten-Model.

FIG. 6B shows a formula derived from the Barten-Model and which calculates the luminance corresponding to the next 1 JND difference from any the luminance.

FIG. 7A is a formula for converting the luminance to the JND values, as specified by the DICOM.

FIG. 7B is a formula for converting the JND value to the luminance, as specified by the DICOM.

FIG. 8A is a formula used to calculate ΔJND.

FIG. 8B is a formula used to calculate the target JND value when the minimum luminance is less than 0.05 (cd/m$^2$).

FIG. 8C is a formula used to calculate the target JND value when the minimum luminance is 0.05 (cd/m$^2$) or larger.

FIG. 11 is a table showing each gradation, the target JND value, and the target luminance.

DETAILED DESCRIPTION

Figure 1:
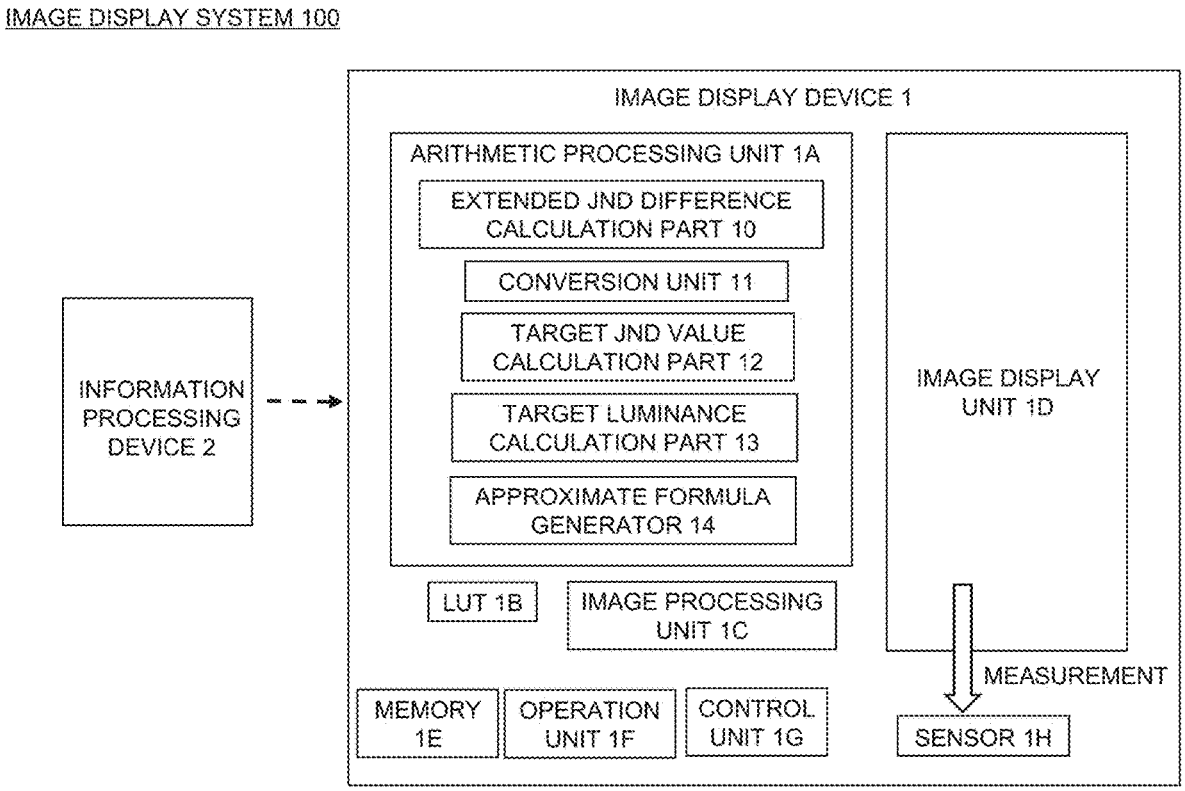
FIG. 1 is a functional block diagram of the image display system 100 having the image display device 1 according to the embodiment.

Now, embodiments of the present invention will be described with reference to the drawings. Various features described in the embodiments below can be combined with each other.

1. Gradation Characteristic

1-1. Dicom Standard

The image display device for medical use should ensure consistency in image display to enable doctors and others to accurately read and diagnose images. For this reason, the image display device that complies with the DICOM standard (hereinafter referred to as DICOM), an international standard for digital images for medical use, has been proposed.

The DICOM specifies the GSDF (Grayscale Standard Display Function), a function that indicates the gradation characteristic. Human visual characteristics are non-linear with respect to brightness, but the GSDF is specified to be linear. Specifically, the GSDF is derived from the Barten-Model, which is based on human visual characteristics in image display.

In the DICOM, an index called the JND (Just-Noticeable Difference) Index is used. The starting point of the JND index is at a luminance of 0.05 (cd/m$^2$), which is defined as "1". After the JND indexes "2", the number of the JND index increases by 1 JND. 1 JND corresponds to the minimum luminance difference in the image recognizable by an average observer. In other words, since one step in the JND index is defined so as to attributed to the luminance difference which is the discrimination threshold, the corresponding luminance for the JND index is uniquely determined.

The JND index described here is specified as a positive integer. On the other hand, the JND value is the value assigned to each gradation and can be a value other than an integer. However, while the JND index and the JND value differ in whether or not they are integers, both the JND index and the JND value are essentially the same and are the Barten-Model compliant.

1-2. Gradation Characteristics of Embodiment

The DICOM does not specify the JND index corresponding to the luminance of less than 0.05 (cd/m$^2$). In other words, the GSDF specified by the DICOM is not applicable for luminance less than 0.05 (cd/m$^2$). Therefore, if the luminance of less than 0.05 (cd/m$^2$) is assigned to the display gradation of the image display device, the gradation characteristic of the image display device will be outside of the GSDF of the DICOM. Thus, in an embodiment, the JND index corresponding to the luminance of less than 0.05 (cd/m$^2$) is specified using the same Barten Model and the same parameters that were used to calculate the GSDF. To be compatible with the JND indexes of the DICOM standard, the JND indexes corresponding to the luminance of less than 0.05 cd/m$^2$ are defined and extended using 0 and negative integers that cannot be taken originally. The JND value is also expressed as 0 and negative, and can be a value other than an integer (e.g., a real number). Specifically, the gradation characteristic of the image display device 1 according to the embodiment is configured from the first and second gradation characteristics.

The luminance of the first gradation characteristic is 0.05 (cd/m$^2$) or more. And the first gradation characteristic complies with the gradation characteristic of the GSDF of the DICOM. In other words, the first gradation characteristic is represented by the JND index already specified by the DICOM and the corresponding luminance for the JND index.

The luminance of the second gradation characteristic is less than 0.05 (cd/m$^2$). Preferably, the luminance of the second gradation characteristic is more than 0.001 (cd/m$^2$) but less than 0.05 (cd/m$^2$). As described above, the GSDF of the DICOM is not applicable for the luminance less than 0.05 (cd/m$^2$). Therefore, in the embodiment, in order to extend the applicable range of the GSDF from the luminance above 0.05 (cd/m$^2$) to the luminance less than 0.05 (cd/m$^2$), the JND index of the second gradation characteristic is obtained based on the Barten-Model. The JND index of the second gradation characteristic is specified as an integer less than 1, which is extended from the JND index of GSDF, which is specified as an integer larger than 1. For this reason, in the embodiment. The JND index of the second gradation characteristic may be referred to as the extended JND index, and the second gradation characteristic may be referred to as the gradation characteristic of the extended GSDF. The method of obtaining the extended JND index is described later.

2. Overall Configuration

This section describes the overall configuration of an image display system 100, including an image display device 1 according to the embodiment. The image display system 100 of this embodiment has the image display device 1 and an information processing device 2, as shown in FIG. 1. The image display device 1 includes an arithmetic processing unit 1A, a LUT (Look Up Table) 1B, an image processing unit 1C, an image display unit 1D, a memory 1E, an operation unit 1F, a control unit 1G, and a sensor 1H.

Each of the above components may be realized by software or by hardware. When realized by software, various functions can be realized by the CPU executing the computer program. The program may be stored in built-in memory or a computer-readable non-transitory storage medium. Further, the program stored in the external the memory may be read and realized by so-called cloud computing. When realized by hardware, it can be realized by various circuits such as ASIC, FPGA, or DRP. The present embodiment deals with various information and concepts encompassing the same, which are represented by high and low signal values as a collection of binary bits consisting of 0 or 1, and communication and arithmetic operations can be performed by the above software or hardware manner.

The image display device 1 according to the embodiment can be applied, for example, to an image reading system for medical use or an image diagnosis system for medical use. The image display device 1 according to the embodiment can also be applied, for example, to a diagnostic method using medical images. The image display device 1 acquires the image data from the information processing device 2 and outputs the processed image data to the image display unit 1D. The information processing device 2 controls the image display device 1 and the sensor 1H. In addition, the information processing device 2 outputs the image data to the image display unit 1D for display on the image display device 1. The sensor 1H measures the luminance of the image display unit 1D. In the embodiment, the sensor 1H is described as being built into the image display device 1, but it is not limited to this configuration.

3. Detailed Configuration of Image Display Device 1

3-1. Arithmetic Processing Unit 1A

The arithmetic processing unit 1A reads the program stored in the memory 1E and executes various arithmetic processes, and is configured with the CPU, for example. The arithmetic processing unit 1A includes an extended JND difference calculation part 10, a conversion unit 11, a target JND value calculation part 12, a target luminance calculation part 13 and an approximate formula generator 14. The JND value and JND index described above are used in the arithmetic processing unit 1A.

As will be explained next, the function of the arithmetic processing unit 1A is different when the minimum luminance Lmin is less than 0.05 (cd/m$^2$) and when it is 0.05 (cd/m$^2$) or more. When the minimum luminance Lmin is less than 0.05 (cd/m$^2$), the arithmetic processing unit 1A performs the processing related to the gradation characteristics of both the first and second gradation characteristics. In contrast, when the minimum luminance Lmin is 0.05 (cd/m$^2$) or more, the arithmetic processing unit 1A performs the processing related to the gradation characteristic of the first gradation characteristic. In this case, the process is the same as the conventional one. First, the case where the minimum luminance Lmin is less than 0.05 (cd/m$^2$) is described.

3-1-1. In Case where Minimum Luminance Lmin is Less than 0.05 (Cd/m$^2$) (Extended JND Difference Calculation Part 10)

The extended JND difference calculation part 10 acquires the various parameters and the minimum luminance Lmin. The various parameters are the parameters of the Barten-Model, such as $M_{opt}$ shown in FIG. 6A. The various parameters are stored in the memory 1E. When the operator of the image display device 1 enters the value of the minimum luminance Lmin using the operation unit 1F, the extended JND difference calculation part 10 can acquire the minimum luminance Lmin.

The extended JND difference calculation part 10 has a function to calculate the temporary minimum luminance Lmin_tmp from the minimum luminance Lmin using a predetermined relationship (the first function). The predetermined relationship is represented by the formula shown in FIG. 6B, which is based on the Barten-Model.

The extended JND difference calculation part 10 also has a function to calculate the luminance using the formula shown in FIG. 6B (the second function).

First Function: Calculation of Temporary Minimum Luminance Lmin_Tmp

The formula shown in FIG. 6B is derived from the contrast sensitivity function shown in FIG. 6A. $q_1$ to $q_3$ are the values shown in FIG. 6A, and $M_{opt}$ is the optical modulation transfer function, $C_{sph}$ is the main pupil diameter dependent component, d is the pupil diameter, and $\sigma_0$ is the standard deviation of the optical LSF (Line Spread Function) for small pupil diameters. This predetermined relationship, given the minimum luminance Lmin, can recursively calculate the corresponding luminance for the JND value that is n (n≥1 and a positive integer) larger than the minimum luminance. The process of recursively calculating the luminance using the predetermined relationship is explained based on FIG. 9.

Figure 9:
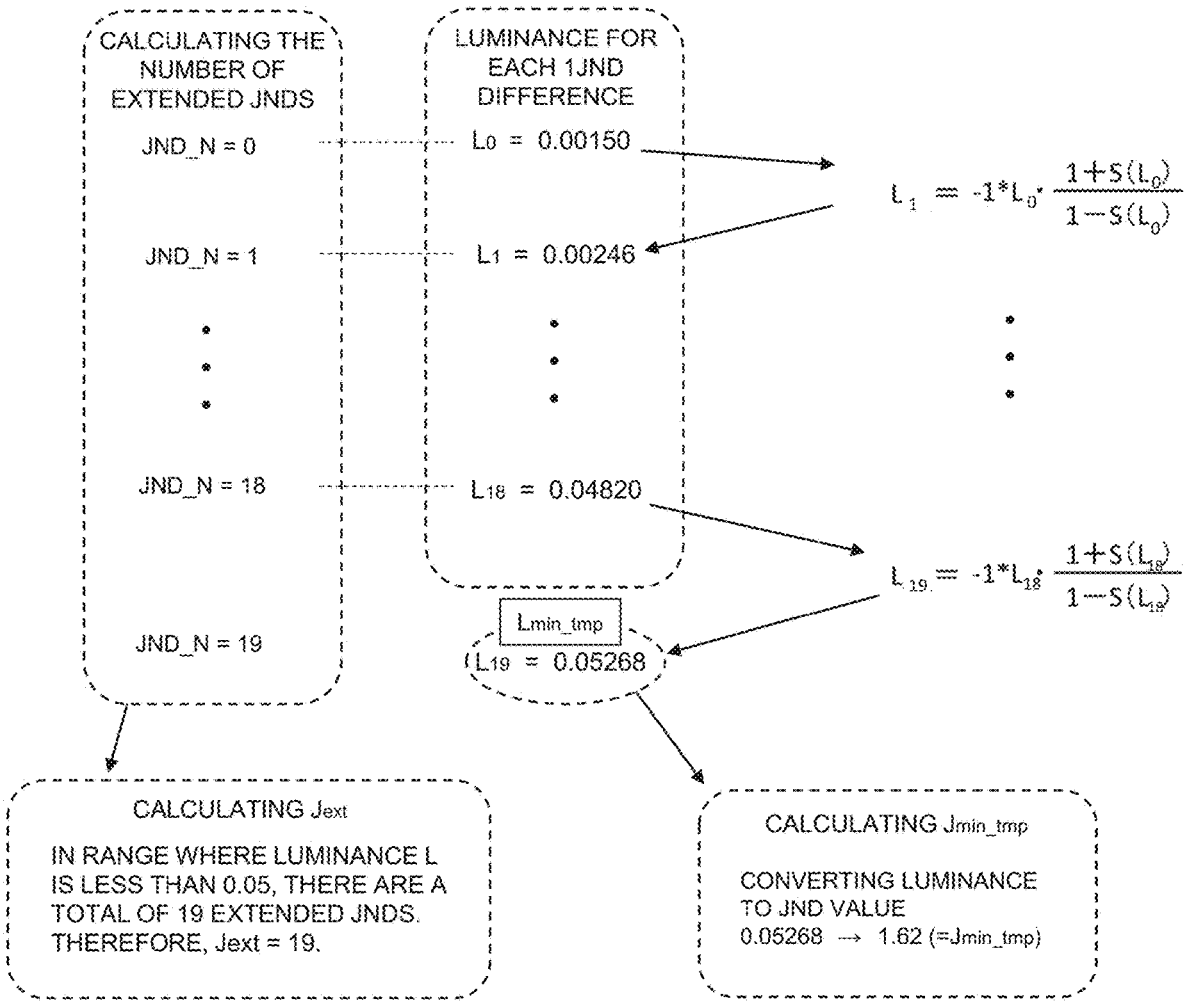
FIG. 9 is a schematic diagram illustrating the calculation of the temporary minimum luminance from the minimum luminance using the contrast sensitivity function.

In FIG. 9, $L_0$ is the minimum luminance. The number of each luminance are given for convenience. In other words, each the luminance number (0-19) in FIG. 9 is different from the JND index (1-19) in the JND index table specified by the DICOM. In FIG. 9, the minimum luminance $L_0$ is less than 0.05 (cd/m$^2$), which is not specified by the JND index table of the DICOM.

Given the minimum luminance $L_0$, the luminance $L_1$ can be calculated by using the formula shown in FIG. 6B. After this recursive calculation is repeated, the value exceeds 0.05 (cd/m$^2$) for the first time at $L_{19}$. In the embodiment, the luminance that exceeds 0.050 (cd/m$^2$) for the first time is defined as the temporary minimum luminance Lmin_tmp. In other words, the temporary minimum luminance Lmin_tmp is the luminance that is above the predetermined luminance (0.05 in the case of the embodiment) for the first time when repeated recursively calculating each luminance using the predetermined relationship. Therefore, in FIG. 9, $L_{19}$ is the temporary minimum luminance Lmin_tmp.

Second Function: Calculation of Extended JND Difference Jext

Each luminance shown in FIG. 9 is the corresponding luminance for the extended JND. The number of the extended JND is counted in order from the smallest luminance in each luminance. In other words, the number of the JND for the minimum luminance $L_0$ is assigned 0, and the number of the JND for the luminance $L_1$ is assigned 1. The luminance after the luminance $L_2$ will be assigned sequentially. Here, the extended JND difference Jext corresponds to the number of JNDs whose luminance is less than 0.05 (cd/m$^2$), as shown in FIG. 9. In other words, the extended JND difference Jext corresponds to the number of JNDs that are smaller than the temporary minimum luminance Lmin_tmp. In FIG. 9, there are a total of 19 values ($L_0$ to $L_{18}$) for which the luminance is smaller than $L_{19}$, which corresponds to the temporary minimum luminance Lmin_tmp. Therefore, in FIG. 9, the extended JND difference Jext is 19.

Second Function: Calculation of Extended JND Index

The extended JND difference calculation part 10 can also acquire the extended JND index, as explained next.

In FIG. 9, the temporary minimum JND value Jmin_tmp was different from the luminance (=0.05 (cd/m$^2$)) of the JND index=1. Here, the extended JND difference calculation part 10 defines the minimum luminance $L_0$ (starting luminance) so that the temporary minimum JND value Jmin_tmp corresponds to the luminance of the JND index=1.

Figure 10:
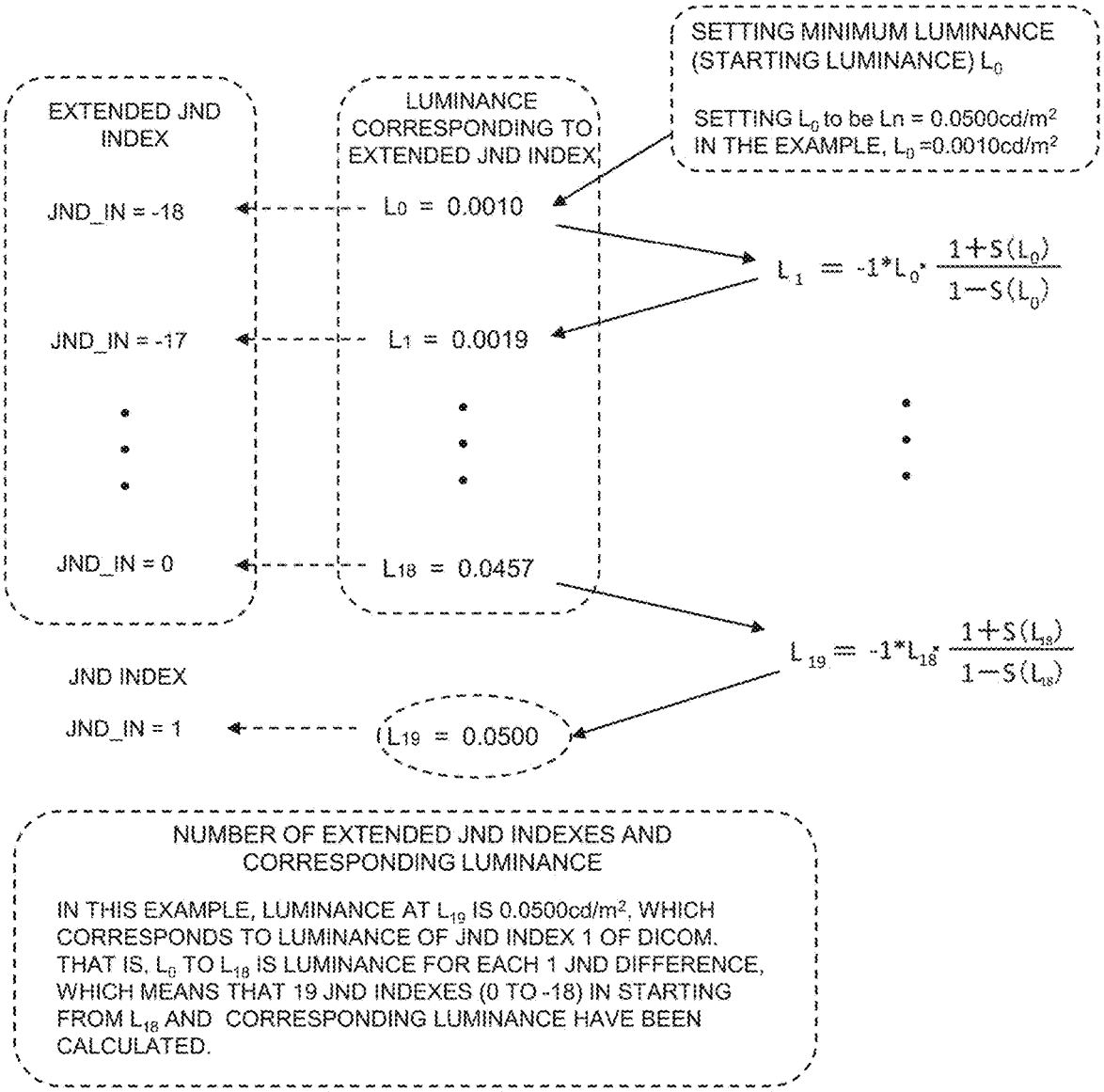
FIG. 10 is a schematic diagram illustrating the calculation of the extended JND index.

Specifically, as shown in FIG. 10, the extended JND difference calculation part 10 defines the minimum luminance $L_0$ to be 0.0010 (cd/m$^2$). Then, the extended JND difference calculation part 10 performs the calculations described in the second function in turn and calculates the luminance $L_0$ to the luminance $L_{19}$. Here, when the extended JND difference calculation part 10 defines the minimum luminance $L_0$ to be 0.0010 (cd/m$^2$), the $L_{19}$ corresponding to the temporary minimum JND value Jmin_tmp is 0.05 (cd/m$^2$), which is equal to the luminance of the JND index=1. Therefore, $L_0$ to $L_{18}$ can be specified as the luminance corresponding to the JND index of less than 1. In other words, $L_{18}$ is the luminance corresponding to JND index=0, $L_{17}$ is the luminance corresponding to JND index=−1, and . . . $L_0$ is the luminance corresponding to JND index=−18. From the above, the extended JND difference calculation part 10 can acquire the JND index less than 1, i. e., the extended JND index, and the corresponding luminance Conversion Unit 11

Figure 2:
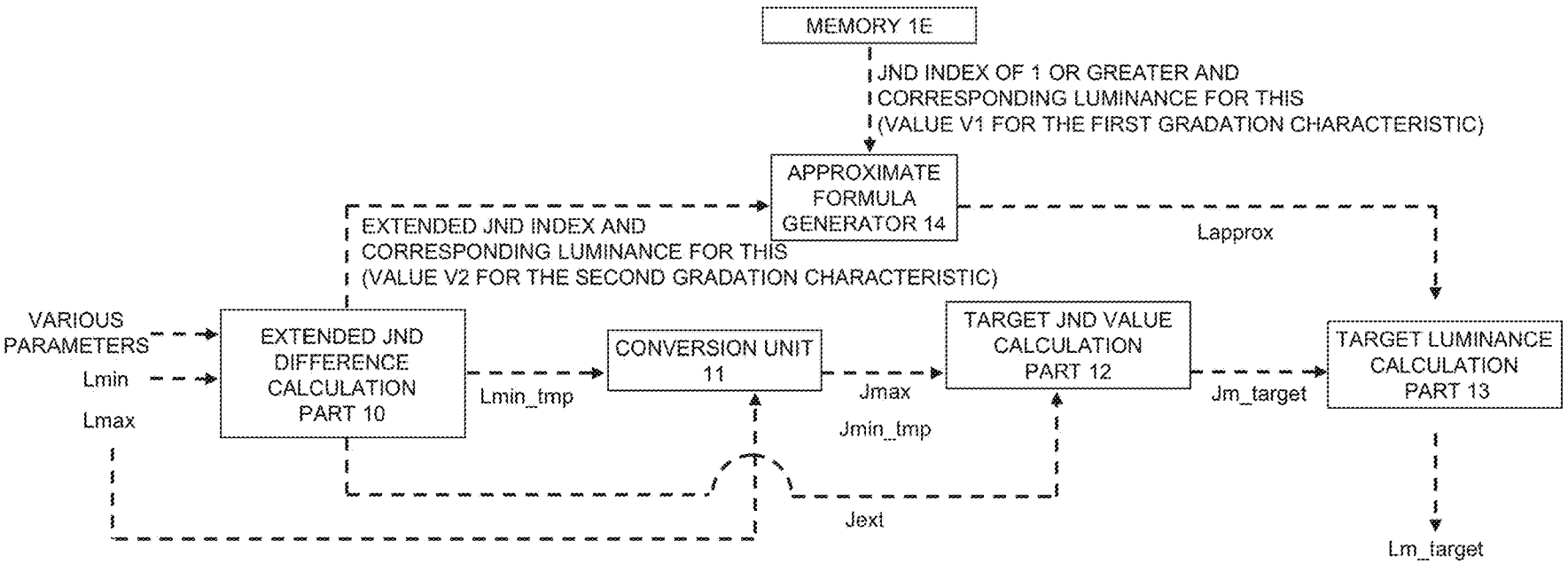
FIG. 2 is a description diagram of the data when the minimum luminance is less than 0.05 (cd/m$^2$).

The conversion unit 11 acquires the temporary minimum luminance Lmin_tmp and the maximum luminance Lmax. As shown FIG. 2, the conversion unit 11 acquires the temporary minimum luminance Lmin_tmp from the extended JND difference calculation part 10. When the operator of the image display device 1 enters the value of the maximum luminance Lmax using the operation unit 1F, the conversion unit 11 acquires the maximum luminance Lmax. Since the temporary minimum luminance Lmin_tmp and the maximum luminance Lmax are both larger than 0.05 (cd/m$^2$), formula 3 specified by the DICOM can be applied. In other words, the conversion unit 11 has the function to convert the luminance to the JND value based on formula 3 specified by the DICOM, as shown in FIG. 7A. Specifically, as shown in FIG. 2, the conversion unit 11 converts the temporary minimum luminance Lmin_tmp calculated by the extended JND difference calculation part 10 to the temporary minimum JND value Jmin_tmp. The conversion unit 11 converts the maximum luminance Lmax to the maximum JND value Jmax.

Target JND Value Calculation Part 12

The target JND value calculation part 12 acquires the temporary minimum JND value Jmin_tmp and the maximum JND value Jmax from the conversion unit 11. Also, the target JND value calculation part 12 acquires the extended JND difference Jext from the extended JND difference calculation part 10. The target JND value calculation part 12 calculates the target JND value Jm_target for each gradation based on the maximum JND value Jmax, the extended JND difference Jext, the temporary minimum JND value Jmin_tmp, and the number of gradations. In the embodiment, it is described that there are gradations from 0 to 255, but it is not limited to this. The process of calculating the target JND value Jm_target is described below.

First, the target JND value calculation part 12 calculates ΔJND based on formula 5 shown in FIG. 8A. ΔJND is the difference in the JND values between adjacent gradations. The difference in the JND values between adjacent gradations is the same for all adjacent gradations. In the embodiment, the maximum luminance Lmax is set to 1000 (cd/m$^2$). In this case, the maximum JND value is 810.49. As shown in FIG. 9, the minimum luminance is set to 0.0015 (cd/m$^2$). At this time, the $L_{19}$ corresponding to the temporary minimum luminance, calculated by recursive calculation, is 0.05268 (cd/m$^2$). Therefore, the temporary minimum JND value Jmin_tmp is 1.62 (cd/m$^2$). Also, as described above, Jext is 19. Thus, as shown in FIG. 8*a*, ΔJND is 3.246.

Next, the target JND value calculation part 12 calculates the target JND value Jm_target for each gradation based on formula 6 shown in FIG. 8B. In formula 6, m is an integer between 0 and 255. The relationship between each gradation and the target JND value is shown in FIG. 11. In FIG. 11, the six target JND values within the dashed rectangle shown in FIG. 11 have values less than 1 and correspond to the extended JND index (−19 to 0).

Target Luminance Calculation Part 13

Figure 12:
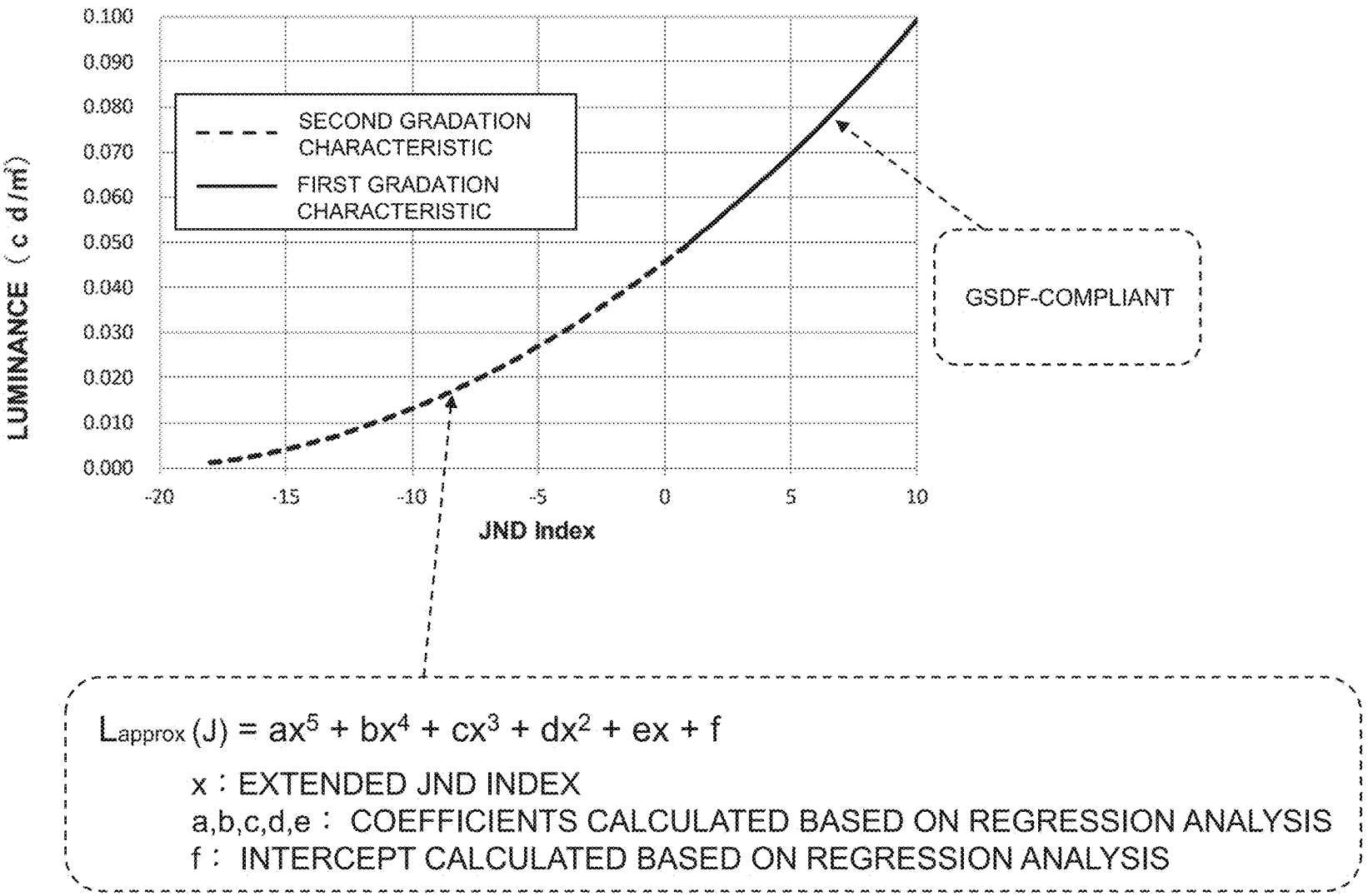
FIG. 12 is a graph showing the first and second gradation characteristics.

The target luminance calculation part 13 calculates the target luminance of the first and second gradation characteristics (see FIG. 12) based on the target JND value for each gradation. In the range where the target JND value is larger than 1 (the range of the first gradation characteristic), the target luminance calculation part 13 converts the target JND value to the target luminance based on formula 4 shown in FIG. 7B. In other words, the first gradation characteristic complies with the gradation characteristic of the GSDF of the DICOM. That is, the first gradation characteristic is defined to satisfy the relationship between the JND value (the JND index) of 1 or more and the corresponding luminance for this (see the solid line in FIG. 12).

Formula 4 cannot be applied when the target JND value is less than 1. For this reason, in the range where the target JND value is less than 1 (the range of the second gradation characteristic), the target luminance calculation part 13 converts the target JND value to the target luminance based on the approximation formula Lapprox described below.

The extended JND index acquired by the extended JND difference calculation part 10 has integer JND values, but the approximation formula Lapprox can be applied to non-integer JND values. In other words, the extended JND index and the corresponding luminance for this and the approximation formula Lapprox are essentially the same gradation characteristic, although there is a difference in whether the applicable JND values include non-integers or not. That is, the approximate formula Lapprox is a formula that expresses the relationship between the JND value (the JND index) of less than 1 and the corresponding luminance for this. Thus, in the embodiment, the approximation formula Lapprox (see dashed line in FIG. 12) is a formula that defines the second gradation characteristic. Then, the second gradation characteristic is defined so that it satisfies the relationship between the JND value (the JND index) of less than 1 and the corresponding luminance for this (the dashed approximate formula Lapprox in FIG. 12).

As described above, the first gradation characteristic (the gradation characteristic having the luminance of 0.05 (cd/m$^2$) or more) complies with the gradation characteristic of the GSDF of the DICOM, it satisfies the relationship between the JND value and the corresponding luminance for this. The second gradation characteristic (the gradation characteristic having a luminance less than 0.05 (cd/m$^2$)) also satisfies the relationship between the JND value and the corresponding luminance for this. Therefore, in the embodiment, the gradation characteristic compatible with the GSDF is extended to the luminance region of less than 0.05 (cd/m$^2$).

Approximate Formula Generator 14

Formula 4 is a formula that converts the JND value to luminance, but it cannot be applied when the JND value is less than 1. The extended JND index is an integer, but the target JND value for each gradation is not necessarily an integer. Based on these, the approximate formula generator 14 generates a formula that can properly convert the JND value to the luminance even if the JND value is less than 1 and the JND value is not an integer.

Here, the existing JND value corresponding to the GSDF and the corresponding luminance for this are referred to as the value V1 for the first gradation characteristic (see FIG. 2). Also, the extended JND value and the corresponding luminance for this are referred to as the value V2 for the second gradation characteristic. The approximate formula generator 14 generates the approximate formula Lapprox based on the values V1 and V2 for the first and second gradation characteristic. The type of the approximation formula Laprox is assumed to be a fifth-order function in the embodiment, but it is not limited to this and can be changed as needed.

The approximate formula generator 14 generates the approximate formula Lapprox using the value V1 for the first gradation characteristic in addition to the value V2 for the second gradation characteristic (see FIG. 12) so that the approximate formula Lapprox to be smoothly connected to the GSDF-based curve (the curve in the range where the JND index is larger than or equal to 1).

The value V1 for the first gradation characteristic may have the same number of JND indexes as the extended JND index, for example. In other words, in the embodiment, the value V2 for the second gradation characteristic has the JND index of −18 to 0 and the corresponding luminance for this, so the value V1 for the first gradation characteristic should have the JND index of 1 to 19 and the corresponding luminance for this. The approximate formula generator 14 substitutes the values V1 and V2 for the first and second gradation characteristics into the approximate formula Lapprox and performs regression analysis to acquire the coefficients a to e and the intercept f of the approximate formula Lapprox. This allows the approximate formula generator 14 to generate the approximate formula Lapprox.

3-1-2. In Case where Minimum Luminance Lmin is 0.05 (Cd/m$^2$) or More Conversion Unit 11

Figure 3:
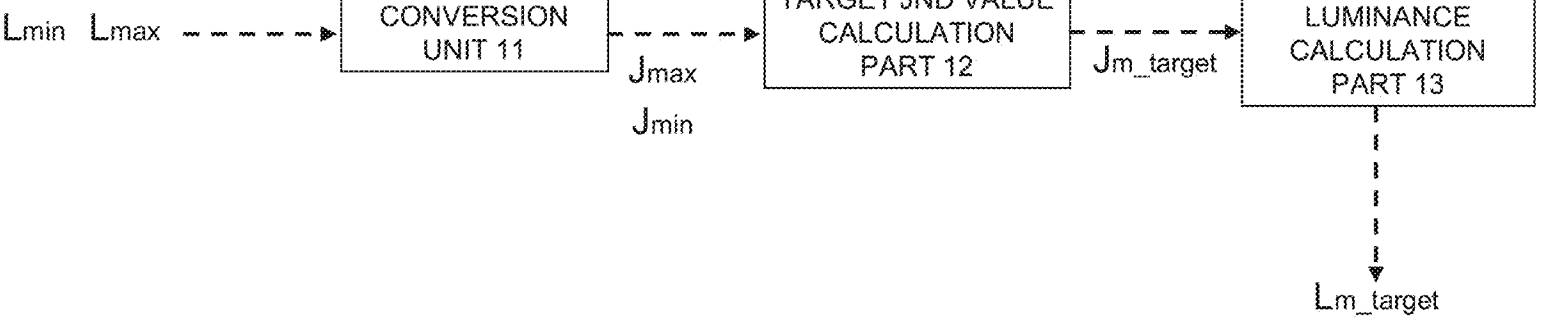
FIG. 3 is a description diagram of the data when the minimum luminance is 0.05 (cd/m$^2$) or more.

As shown in FIG. 3, the conversion unit 11 acquires the minimum luminance Lmin and the maximum luminance Lmax. The operator of the image display device 1 inputs the values of the minimum luminance Lmin and the maximum luminance Lmax using the operation unit 1F, and the conversion unit 11 acquires the minimum luminance Lmin and the maximum luminance Lmax. The conversion unit 11 converts the minimum luminance Lmin to the minimum JND value Jmin, and the maximum luminance Lmax to the maximum JND value Jmax.

Target JND Value Calculation Part 12

The target JND value calculation part 12 calculates the target JND value Jm_target in a known manner, as described below. As shown in FIG. 3, the target JND value calculation part 12 acquires the minimum JND value Jmin and the maximum JND value Jmax from the conversion unit 11. The target JND value calculation part 12 calculates the target JND value Jm_target for each gradation based on the minimum JND value Jmin, the maximum JND value Jmax, and the number of gradations. Specifically, the target JND value calculation part 12 calculates the target JND value Jm_target based on formula 7 shown in FIG. 8C.

Target Luminance Calculation Part 13

The target luminance calculation part 13 calculates the target luminance of the first gradation characteristic based on the target JND value for each gradation. The target luminance calculation part 13 converts the target JND value to the target luminance based on formula 4 shown in FIG. 7B.

3-2. LUT 1B

LUT 1B has LUT data. The LUT data is configured as a table of output data (conversion table) that is associated with the input data. The input data corresponds to the image data to be acquired from the information processing device 2, and the image data converted through the LUT 1B is input to the image processing unit 1C. As the image display device 1 includes LUT 1B, it is easy to change the mapping of the LUT data. The number of gradations that can be represented in the LUT data (bit depth) is specific to the image display device 1, and generally there are more bits in the output data than in the input data.

As the process of performing the calibration shown in FIG. 4 below, the LUT data of the image display device 1 is set to default values. Then, the control unit 1G adjusts the luminance of the white so that the luminance of the image display unit 1D is above the maximum luminance value, which is generally the target. The image used for the measurement may be the image data from the information processing device 2, or it may be the specified image data stored in advance by the image display device 1. The sensor 1H measures the luminance of the image display unit 1D at the specified gradation value (measurement gradation value). Here, in the image display device 1, the measured gradation value and the corresponding measured luminance are mapped to the LUT data of the basic characteristics of the image display device 1. Then, when the target luminance calculation part 13 acquires the target luminance of each gradation, the suitable LUT data is selected from the LUT data of the basic characteristics to make the target luminance of each graduation. In the area where the luminance is 0.05 (cd/m$^2$) or more, the target luminance acquired by the target luminance calculation part 13 complies with the GSDF. Also, in the area where the luminance is less than 0.05 (cd/m$^2$), the target luminance acquired by the target luminance calculation part 13 complies with the extended GSDF. Therefore, LUT 1B will be selected as the LUT data corresponding to the GSDF or the extended GSDF. The luminance of the LUT data between the measured gradation values can be acquired by interpolation.

3-3. Image Processing Unit 1C and Image Display Unit 1D

The image processing unit 1C performs image processing based on the LUT data (output), and the image display unit 1D displays the processed data. The image display unit 1D displays image data (including still images and videos) as images. The image display unit 1D can be configured with a liquid crystal display and an organic EL display, for example.

3-4. Memory 1E

The memory 1E stores various data and programs. The memory 1E stores, for example, the Barten-Model parameters, formulas 1 to 7 shown in FIG. 6A to 8C, and so on. Also, the image data for the measurement of the sensor 1H is stored in the memory 1E.

3-5. Operation Unit 1F

The image display device 1 is operated by the operation unit 1F, which can be configured with buttons, a touch panel, and a voice input device, for example. In the embodiment, the minimum luminance Lmin and the maximum luminance Lmax are input through the application that the information processing device 2 has, but may be input using the operation unit 1F.

3-6. Control Unit 1G

The control unit 1G controls (adjusts) the luminance of the image displayed on the image display unit 1D when performing the calibration described in the flowchart below.

3. Flowchart 3-1. Overall Configuration

Figure 4:
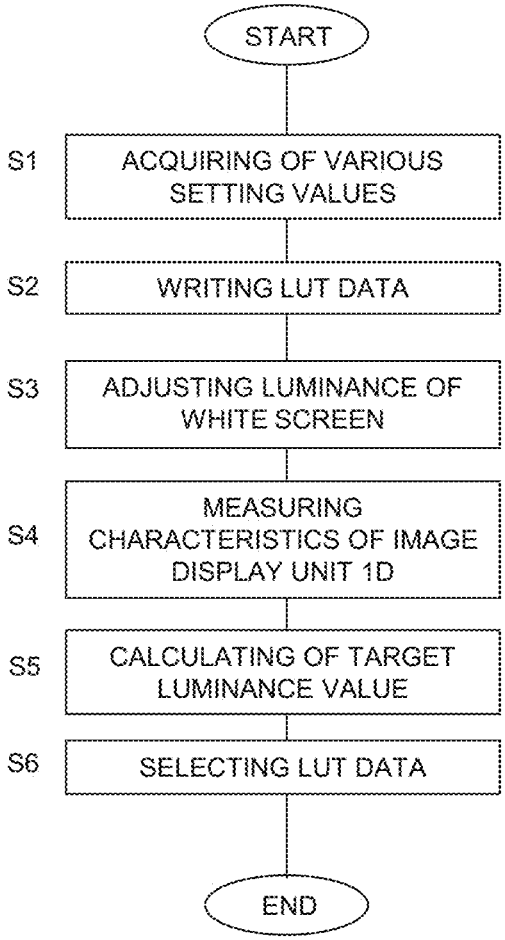
FIG. 4 is a flowchart for mapping the LUT (Look Up Table) data to the target luminance obtained in the flowchart shown in FIG. 5.

An example of a control flowchart of the image display system 100 is described based on FIG. 4. The flowchart in FIG. 4 shows the basic process of calibration, which includes the luminance adjustment of the white screen (step S3), and the LUT adjustment to select the suitable LUT data to make the display luminance of each gradation the target luminance (step S6).

The operator inputs the minimum luminance Lmin and the maximum luminance Lmax via the information processing device 2 application, and the image display device 1 acquires the minimum luminance Lmin and the maximum luminance Lmax (step S1). The minimum luminance Lmin can also be the value measured by the sensor 1H. The arithmetic processing unit 1A writes the default value of the LUT data stored in advance in the memory 1E to the LUT (step S2). The control unit 1G makes the white screen data appear on the image display unit 1D, the sensor 1H measures the luminance of the image display unit 1D, and the control unit 1G adjusts the luminance of the image display unit 1D (step S3). The control unit 1G repeats the change of the luminance of the image display unit 1D and the measurement of luminance by the sensor 1H until it is within the predetermined range of the luminance.

The image data of the specified plurality of gradations stored in the memory 1E is displayed on the image display unit 1D, and the sensor 1H measures the luminance of the image display unit 1D (step S4). The measured luminance of the unmeasured gradations can be acquired by interpolation.

The arithmetic processing unit 1A acquires the target luminance (step S5). The details of step S5 are described in "3-2. TARGET LUMINANCE CALCULATION FLOW". Then, the arithmetic processing unit 1A selects the suitable LUT data to make the target luminance based on the measured luminance acquired in step S4 and the target luminance acquired in step S5 (step S6).

3.2 Target Luminance Calculation Flow

Figure 5:
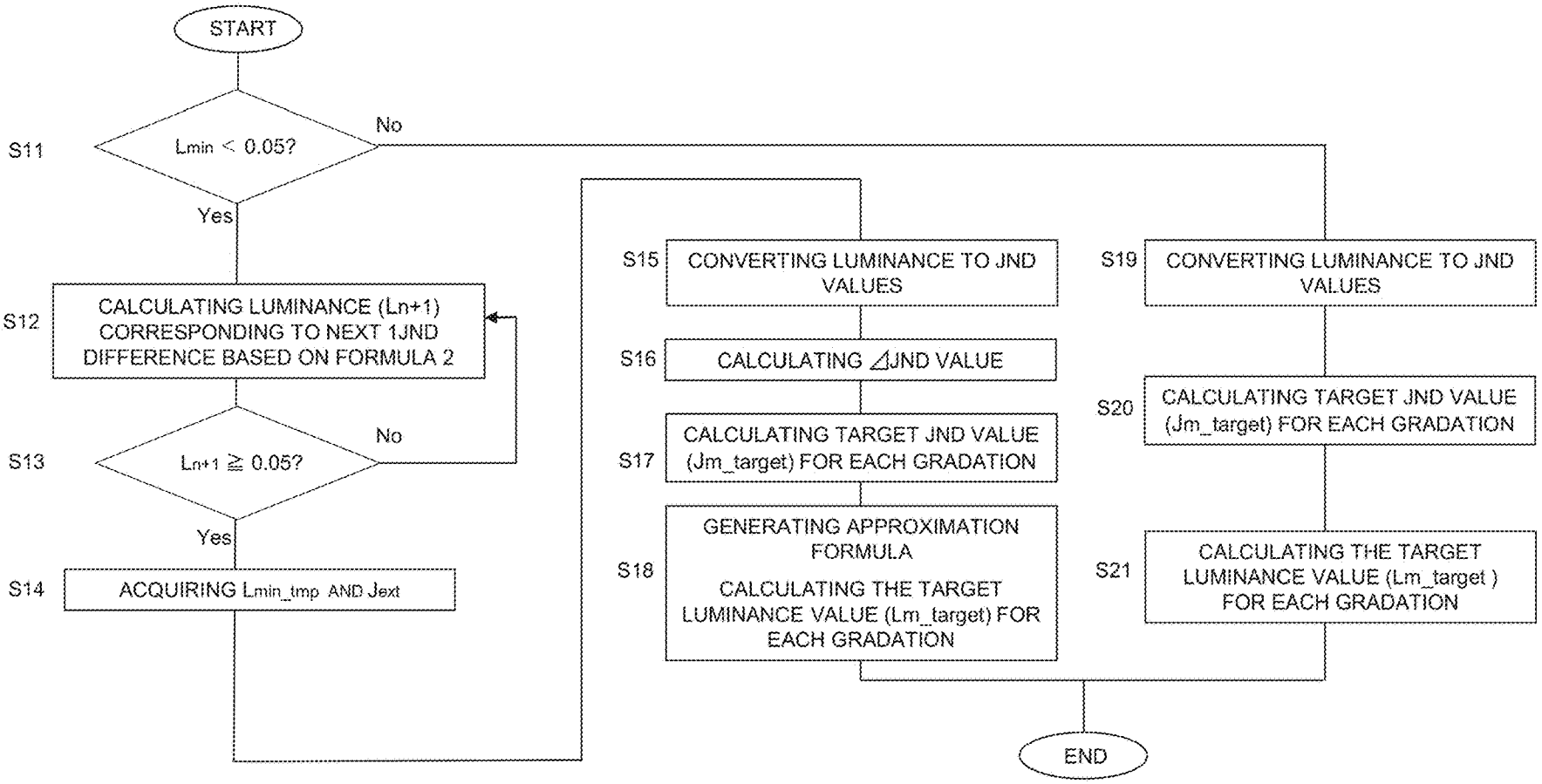
FIG. 5 is a detailed flowchart of step S5 (a calculation step of the target luminance) of the flowchart shown in FIG. 4.

An example of a flowchart for acquiring the target luminance is described based on FIG. 5.

Step S11

The arithmetic processing unit 1A determines whether the minimum luminance Lmin is less than 0.05 (cd/m$^2$). If the minimum luminance Lmin is less than 0.05 (cd/m$^2$), move to step S12, if the minimum luminance Lmin is larger than 0.05 (cd/m$^2$), move to step S19.

In the case of moving from step S11 to step S12, the minimum luminance Lmin is less than 0.05 (cd/m$^2$), so the image display device 1 needs to display the image data while taking into account not only the first gradation characteristic but also the second gradation characteristic. Therefore, the arithmetic processing unit 1A performs the steps described below and acquires the extended JND value.

On the other hand, in the case of moving from step S11 to step S19, the minimum luminance Lmin is 0.05 (cd/m$^2$) or more, so the image display device 1 can display the image data while taking into account the first gradation characteristic (GSDF). In this case, the target luminance can be acquired in the same manner as the existing method.

Step S12 to Step S14: Acquisition of Lmin_Tmp and Jext by Recursive Calculations The extended JND difference calculation part 10 substitutes the minimum luminance $L_0$ corresponding to the minimum extended JND index into the formula shown in FIG. 6B, and calculates the luminance $L_1$ corresponding to the next extended JND index (step S12). In the embodiment, the minimum luminance $L_0$ is 0.00150 and the luminance $L_1$ is 0.00246. The extended JND difference calculation part 10 determines whether the luminance $L_1$ corresponding to the next extended JND index is 0.05 (cd/m$^2$) or more (step S13). Since the luminance $L_1$ is not larger than 0.05 (cd/m$^2$), the calculation is repeated in Step S12. Step S12 and step S13 are repeated until the luminance $L_{19}$, which is 0.05268 (cd/m$^2$), is calculated. Then, the extended JND difference calculation part 10 acquires the temporary minimum luminance Lmin_tmp ($=L_{19}$) and the extended JND difference Jext as a result of the repeated calculations in step S12 and step S13 (step S14).

Step S15: Converting Luminance to JND Values

The conversion unit 11 converts the maximum luminance Lmax to the maximum JND value Jmax and the temporary minimum luminance Lmin_tmp to the temporary minimum JND value Jmin_tmp based on formula 3 shown in FIG. 7A. In the embodiment, the maximum luminance Lmax is 1000 (cd/m$^2$), so the maximum JND value Jmax is 810.49, and the temporary minimum luminance Lmin_tmp is 0.05268 (cd/m$^2$), so the temporary minimum JND value Jmin_tmp is 1.62.

Step S16 and Step S17: Calculation of ΔJND and Target JND Value

The target JND value calculation part 12 calculates ΔJND using the maximum JND value Jmax, the extended JND difference Jext, the temporary minimum JND value Jmin_tmp, and the number of gradations based on formula 5 shown in FIG. 8A (step S16). In the embodiment, the maximum JND value Jmax is 810.49, the temporary minimum JND value Jmin_tmp is 1.62, and the extended JND difference Jext is 19. Therefore, in the embodiment, ΔJND is 3.246. Next, the target JND value calculation part 12 acquires the target JND value for each gradation based on formula 6 shown in FIG. 8B (step S17).

Step S18: Generation of Approximation Formula Laprox and Calculation of Target Luminance The approximate formula generator 14 generates the approximate formula Lapprox based on the values V1 and V2 for the first and second gradation characteristics. The value V2 for the second gradation characteristic is acquired in the recursive calculation of step S12 to step S14. Also, the approximate formula generator 14 can acquire the value V1 for the first gradation characteristic from the memory 1E.

The target luminance calculation part 13 calculates the target luminance of the first and second gradation characteristics based on the target JND value for each gradation. If the target JND value is larger than or equal to 1, the target luminance calculation part 13 converts the target JND value to the target luminance based on formula 4 shown in FIG. 7B. If the target JND value is less than 1, the target luminance calculation part 13 converts the target JND value to the target luminance based on the approximation formula Lapprox.

Step S19 to Step S21: Calculation of Target Luminance Using Existing Methods The conversion unit 11 converts the maximum luminance Lmax to the maximum JND value Jmax and the minimum luminance Lmin to the minimum JND value Jmin based on formula 3 shown in FIG. 7A (Step S19).

The target JND value calculation part 12 calculates the target JND value Jm_target for each gradation using the maximum JND value Jmax, the minimum JND value Jmin, and the number of gradations based on formula 7 shown in FIG. 8C (step S20).

The target luminance calculation part 13 converts the target JND value for each gradation to the target luminance based on formula 4 shown in FIG. 7B.

4. Modification

Figure 13:
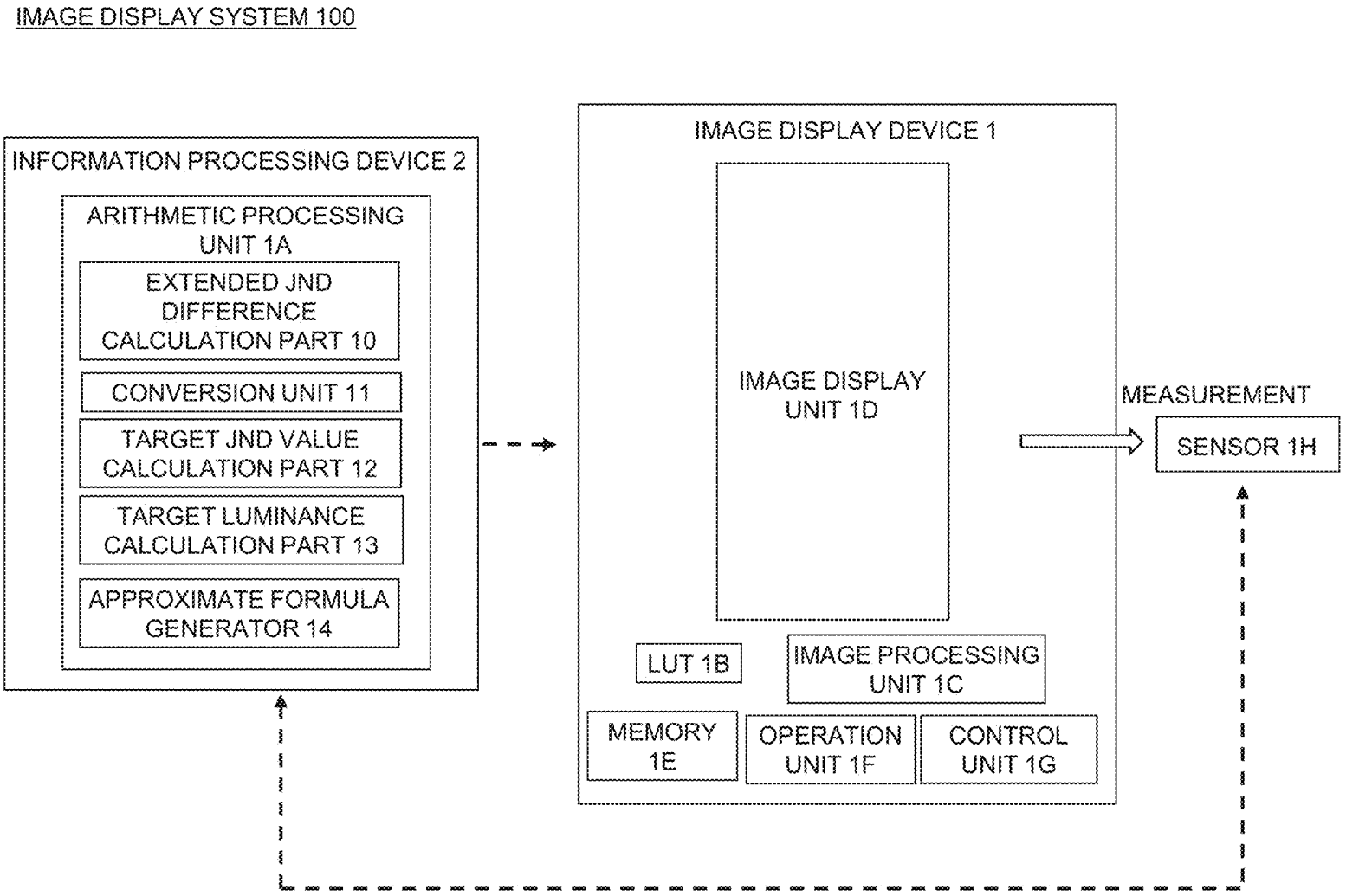
FIG. 13 is a modification of the image display system 100 according to the embodiment.

As shown in FIG. 13, in the image display system 100, the arithmetic processing unit 1A may be included in the information processing device 2. In other words, the information processing device 2 may acquire the relationship between the JND value and the corresponding luminance described in the embodiment in advance, and the image display device 1 may acquire the relationship from the information processing device 2.

Also, in this modification, the sensor 1H is not built into the image display device 1, but is provided outside the image display device 1. In this modification, the information processing device 2 controls the sensor 1H and receives the detection results of the sensor 1H. In addition, the information processing device 2 stores the image data of the specified plurality of gradations. The information processing device 2 outputs the image data of each gradation and the luminance measured by the sensor 1H to the image display device 1, and the calibration described in FIG. 4 is performed. Even with this modification, the same effect as the embodiment can be realized.

5. Other Embodiments

The image display device 1 according to the embodiment may be the image display device that can display color images. For example, the image display device 1 should be able to display an image with the first and second gradation characteristics when displaying a grayscale image.

REFERENCE SIGNS LIST

1: image display device
1A: arithmetic processing unit
1C: image processing unit
1D: image display unit
1E: memory
1F: operation unit
1G: control unit
1H: sensor
2: information processing device
10: extended JND difference calculation part
11: conversion unit
12: target JND value calculation part
13: target luminance calculation part
14: approximate formula generator
100: image display system
Jext: extended JND difference
Jm_target: target JND value
Jmax: maximum JND value
Jmin: minimum JND value
Jmin_tmp: temporary minimum JND value
Lmax: maximum luminance
Lmin: minimum luminance
Lmin_tmp: temporary minimum luminance

The invention claimed is:

1. An image display device for medical use configured to display image data comprising:
- an image display unit; and
- an image processing unit, wherein
- the image processing unit is configured to display the image data on the image display unit based on first and second gradation characteristics,
  - the first gradation characteristic has a luminance of 0.05 cd/m$^2$ or more,
  - the second gradation characteristic has a luminance of less than 0.05 cd/m$^2$,
  - the first gradation characteristic complies with (Grayscale Standard Display Function (GSDF) gradation characteristic of a Digital Imaging and Communications in Medicine (DICOM) standard,
  - the first gradation characteristic is defined to satisfy a relationship between a Just Noticeable Difference (JND) value complying with GSDF and a corresponding luminance,
  - the second gradation characteristic is a gradation characteristic that extends, based on a Barten-Model, over an applicable range of GSDF from a first luminance above 0.05 cd/m$^2$ to a second luminance less than 0.05 cd/m$^2$, and
  - the second gradation characteristic is defined to satisfy a relationship between an extended JND value complying with extended GSDF and a corresponding luminance.

2. The image display device of claim 1, wherein
- the relationship in the second gradation characteristic corresponds to a relationship between a target JND value and a corresponding target luminance,
- the target luminance corresponds to the corresponding luminance,
- the target JND value is calculated based on a maximum JND value, an extended JND difference, a temporary minimum JND value, and a number of gradations, wherein the number of gradations is a predetermined value in the image display device,
  - the maximum JND value corresponds to a maximum luminance of the image display unit,
  - the temporary minimum JND value corresponds to a temporary minimum luminance, and the temporary minimum JND value is calculated from a minimum luminance using a predetermined relationship,
  - the minimum luminance is less than 0.05 cd/m$^2$,
    - when the minimum luminance is given, the predetermined relationship is capable of recursively calculating a luminance corresponding to a JND value that is larger than a minimum JND value corresponding to the minimum luminance by at least a value n, wherein n≥1, the temporary minimum luminance is a luminance that becomes larger than a predetermined luminance for the first time when a recursive calculation of each luminance using the predetermined relationship is repeated, and the extended JND difference corresponds to a number of luminance which is used to calculate the temporary minimum luminance, said number of luminance being smaller than the temporary minimum luminance.

3. The image display device of claim 1 further comprising:

an arithmetic processing unit, wherein the arithmetic processing unit includes an extended JND difference calculation part, a target JND value calculation part, and a target luminance calculation part, the extended JND difference calculation part calculates a temporary minimum luminance from a minimum luminance using a predetermined relationship and calculates an extended JND difference, when the minimum luminance is given, the predetermined relationship is capable of recursively calculating a luminance corresponding to a JND value that is larger than a minimum JND value corresponding to the minimum luminance by at least a value n, wherein n≥1, the temporary minimum luminance is a luminance that becomes larger than a predetermined luminance for the first time when a recursive calculation of each luminance using the predetermined relationship is repeated, the minimum luminance is less than 0.05 cd/m$^2$, the extended JND difference corresponds to a number of luminance which is used to calculate the temporary minimum luminance, said number of luminance being smaller than the temporary minimum luminance, the target JND value calculation part calculates a target JND value for each gradation based on a maximum JND value corresponding to a maximum luminance of the image display unit, the extended JND difference, a temporary minimum JND value corresponding to the temporary minimum luminance, and a number of gradations, wherein the number of gradations is a predetermined value in the image display device, the target luminance calculation part calculates a target luminance based on the target JND value, the target JND value corresponds to the JND value of the first and second gradation characteristics, and the target luminance corresponds to the corresponding luminance of the first and second gradation characteristics.

4. The image display device of claim 1, wherein the JND value for the first gradation characteristic is assigned a real number larger than or equal to 1, and the JND value for the second gradation characteristic is assigned a real number less than 1.

5. The image display device of claim 1, wherein a JND index for the first gradation characteristic is assigned an integer larger than or equal to 1, and a JND index for the second gradation characteristic is assigned an integer less than 1.

6. The image display device of claim 5, wherein the JND index for the second gradation characteristic is assigned a negative integer.

7. An image display system for medical use configured to display image data comprising:

an image display unit; and an image processing unit, wherein the image processing unit is configured to display the image data on the image display unit based on first and second gradation characteristics, the first gradation characteristic has a luminance of 0.05 cd/m$^2$ or more, the second gradation characteristic has a luminance of less than 0.05 cd/m$^2$, the first gradation characteristic complies with (Grayscale Standard Display Function (GSDF) gradation characteristic of a Digital Imaging and Communications in Medicine (DICOM) standard, the first gradation characteristic is defined to satisfy a relationship between a Just Noticeable Difference (JND) value complying with GSDF and a corresponding luminance, the second gradation characteristic is a gradation characteristic that extends, based on a Barten-Model, over an applicable range of GSDF from a first luminance above 0.05 cd/m$^2$ to a second luminance less than 0.05 cd/m$^2$, and the second gradation characteristic is defined to satisfy a relationship between an extended JND value complying with extended GSDF and a corresponding luminance.

8. The image display system of claim 7, wherein the relationship in the second gradation characteristic corresponds to a relationship between a target JND value and a corresponding target luminance, the target luminance corresponds to the corresponding luminance, the target JND value is calculated based on a maximum JND value, an extended JND difference, a temporary minimum JND value, and a number of gradations, wherein the number of gradations is a predetermined value in the image display device, the maximum JND value corresponds to a maximum luminance of the image display unit, the temporary minimum JND value corresponds to a temporary minimum luminance, and the temporary minimum JND value is calculated from a minimum luminance using a predetermined relationship, the minimum luminance is less than 0.05 cd/m$^2$, when the minimum luminance is given, the predetermined relationship is capable of recursively calculating a luminance corresponding to a JND value that is larger than a minimum JND value corresponding to the minimum luminance by at least a value n, wherein n≥1, the temporary minimum luminance is a luminance that becomes larger than a predetermined luminance for the first time when a recursive calculation of each luminance using the predetermined relationship is repeated, and the extended JND difference corresponds to a number of luminance which is used to calculate the temporary minimum luminance, said number of luminance being smaller than the temporary minimum luminance.

9. The image display system of claim 7 further comprising:

an arithmetic processing unit, wherein the arithmetic processing unit includes an extended JND difference calculation part, a target JND value calculation part, and a target luminance calculation part, the extended JND difference calculation part calculates a temporary minimum luminance from a minimum luminance using a predetermined relationship and calculates an extended JND difference, when the minimum luminance is given, the predetermined relationship is capable of recursively calculating a luminance corresponding to a JND value that is larger than a minimum JND value corresponding to the minimum luminance by at least a value n, wherein $n \geq 1$, the temporary minimum luminance is a luminance that becomes larger than a predetermined luminance for the first time when a recursive calculation of each luminance using the predetermined relationship is repeated, the minimum luminance is less than 0.05 cd/m$^2$, the extended JND difference corresponds to a number of luminance which is used to calculate the temporary minimum luminance, said number of luminance being smaller than the temporary minimum luminance, the target JND value calculation part calculates a target JND value for each gradation based on a maximum JND value corresponding to a maximum luminance of the image display unit, the extended JND difference, a temporary minimum JND value corresponding to the temporary minimum luminance, and a number of gradations, wherein the number of gradations is a predetermined value in the image display device, the target luminance calculation part calculates a target luminance based on the target JND value, the target JND value corresponds to the JND value of the first and second gradation characteristics, and the target luminance corresponds to the corresponding luminance of the first and second gradation characteristics.

10. The image display system of claim 7, wherein the JND value for the first gradation characteristic is assigned a real number larger than or equal to 1, and the JND value for the second gradation characteristic is assigned a real number less than 1.

11. The image display system of claim 7, wherein a JND index for the first gradation characteristic is assigned an integer larger than or equal to 1, and a JND index for the second gradation characteristic is assigned an integer less than 1.

12. The image display system of claim 11, wherein the JND index for the second gradation characteristic is assigned a negative integer.

13. An image display method for medical use and displaying image data comprising:

a display step of displaying the image data on an image display unit based on first and second gradation characteristics, wherein the first gradation characteristic has a luminance of 0.05 cd/m$^2$ or more, the second gradation characteristic has a luminance of less than 0.05 cd/m$^2$, the first gradation characteristic complies with (Grayscale Standard Display Function (GSDF) gradation characteristic of a Digital Imaging and Communications in Medicine (DICOM) standard, the first gradation characteristic is defined to satisfy a relationship between a Just Noticeable Difference (JND) value complying with GSDF and a corresponding luminance, the second gradation characteristic is a gradation characteristic that extends, based on a Barten-Model, over an applicable range of GSDF from a first luminance above 0.05 cd/m$^2$ to a second luminance less than 0.05 cd/m$^2$, and the second gradation characteristic is defined to satisfy a relationship between an extended JND value complying with extended GSDF and a corresponding luminance.

14. A non-transitory computer readable medium that stores a computer program causing a computer to execute an image display method for medical use and displaying image data comprising:

a display step of displaying the image data on an image display unit based on first and second gradation characteristics, wherein the first gradation characteristic has a luminance of 0.05 cd/m$^2$ or more, the second gradation characteristic has a luminance of less than 0.05, the first gradation characteristic complies with (Grayscale Standard Display Function (GSDF) gradation characteristic of a Digital Imaging and Communications in Medicine (DICOM) standard, the first gradation characteristic is defined to satisfy a relationship between a Just Noticeable Difference (JND) value complying with GSDF and a corresponding luminance, the second gradation characteristic is a gradation characteristic that extends, based on a Barten-Model, over an applicable range of GSDF from a first luminance above 0.05 cd/m$^2$ to a second luminance less than 0.05 cd/m$^2$, and the second gradation characteristic is defined to satisfy a relationship between an extended JND value complying with extended GSDF and a corresponding luminance.

* * * * *